US005795205A

United States Patent [19]

Gantenbein et al.

[11] Patent Number: 5,795,205

[45] Date of Patent: Aug. 18, 1998

[54] ATTACHMENT FOR SURFBOARD LEASH

[76] Inventors: Rob A. Gantenbein, 2015B Swazey St., San Luis Obispo, Calif. 93401; Andrew A. Jennings, 332 Twinridge Dr., San Luis Obispo, Calif. 93405

[21] Appl. No.: 823,888

[22] Filed: Mar. 17, 1997

[51] Int. Cl.[6] ..... B63B 1/00

[52] U.S. Cl. ..... 441/75

[58] Field of Search ..... 441/74, 65, 79, 441/75; 114/253, 254

[56] References Cited

U.S. PATENT DOCUMENTS

| | | | |
|---|---|---|---|
| 3,802,374 | 4/1974 | Brown | 441/74 |
| 3,879,782 | 4/1975 | Oliver | 441/74 |
| 4,107,806 | 8/1978 | Newland et al. | 441/75 |

FOREIGN PATENT DOCUMENTS

| | | | |
|---|---|---|---|
| 128526 | 12/1984 | European Pat. Off. | 441/75 |

*Primary Examiner*—Stephen Avila
*Attorney, Agent, or Firm*—Daniel C. McKown

[57] ABSTRACT

An article in the form of a plug fits into a rearwardly-opening cavity formed in the trailing edge of a surfboard to provide an attachment for a leash. The article includes an internal passage that connects a first rearwardly-opening hole to a second rearwardly-opening hole. The leash is threaded through this passage and a knot is tied in the free end of the leash to secure the surfboard to the leash. The article has a structure that results in a strong connection with the foam of the interior of the surfboard, and the article is shaped to conform, when installed, to the shape of the surfboard. In a preferred embodiment, the article is formed by injection molding or by bonding two parts together to facilitate formation of the internal passage. Attaching the leash to the trailing edge of the surfboard in the manner described eliminates the effect known as "tombstoneing" after the surfer has fallen from the surfboard.

4 Claims, 4 Drawing Sheets

ATTACHMENT FOR SURFBOARD LEASH

BACKGROUND OF THE INVENTION

REFERENCE TO RELATED APPLICATION

This application claims the benefit of U.S. Provisional Application No. 60/031,411, filed Nov. 20, 1996 for SURFBOARD LEASH ATTACHMENT.

1. Field of the Invention

The present invention is in the field of surfboards, and more specifically the invention relates to an improved article for use in attaching a leash to a surfboard.

2. The Prior Art

It has become common practice for a surfer to use a leash for tethering a surfboard to his or her ankle to reduce the probability that the surfboard will get away from the surfer and be lost. The streamlined shape of a typical surfboard affords no convenient way of attaching the leash to the surfboard. Accordingly, the surfboard must be specifically modified to provide an attachment point for the leash. This modification may be made during the manufacturing process or, in many cases, the modification is made to the board after it has been manufactured.

A typical attachment known in the prior art consists of a thimble-like article within which a metal rod extends diametrically. The attachment is mounted to the surfboard by boring a hole in the surfboard, usually about four inches to a foot forward of the trailing edge of the surfboard, and the attachment is bonded into the bore using an epoxy adhesive. The leash is then tied to the metal rod within the attachment.

This method of attaching the leash to the surfboard causes problems. Usually, the attachment is located at the same region on the upper surface of the board as the surfer's rear foot. In order to avoid standing on the leash, the surfer may have to move his rear foot to a less desirable position, which is a distraction to him. More seriously, in the event of a spill, the location of the attachment point forward of the trailing edge of the surfboard causes the surfboard to become oriented transverse to the direction of the current, which in turn tends to immobilize the surfer or to drag the surfer toward the shore.

This undesirable and potentially dangerous effect, known as "tombstoneing", is caused by the force of the water against the portion of the board between the attachment and the trailing edge of the board. As will be shown below, the present inventors have found a way of preventing the problems that result from positioning the leash attachment point some distance ahead of the trailing edge of the surfboard.

SUMMARY OF THE INVENTION

In accordance with the present invention, the problems of the prior art are overcome by providing a plug that is received in a rearwardly-opening cavity in the trailing edge of the surfboard. The plug includes an internal passage extending from a first rearwardly-opening hole to a second rearwardly-opening hole so that a tether may be threaded through the internal passage and thereby secured to the surfboard. The shape of the plug is such that when it has been epoxied into the rearwardly-opening cavity, the exposed surface of the plug is flush with the surface of the trailing edge of the surfboard. In this way, the leash appears to come out of the trailing edge of the surfboard. As a result, the surfboard aligns itself with the direction of the water current and presents a minimal transverse cross-sectional area to it. Therefore, the force exerted on the surfer by the board is minimized, and the "tombstoneing" effect is eliminated.

In accordance with a preferred embodiment of the present invention, the plug is bonded into the rearwardly-opening cavity by the use of an epoxy adhesive.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
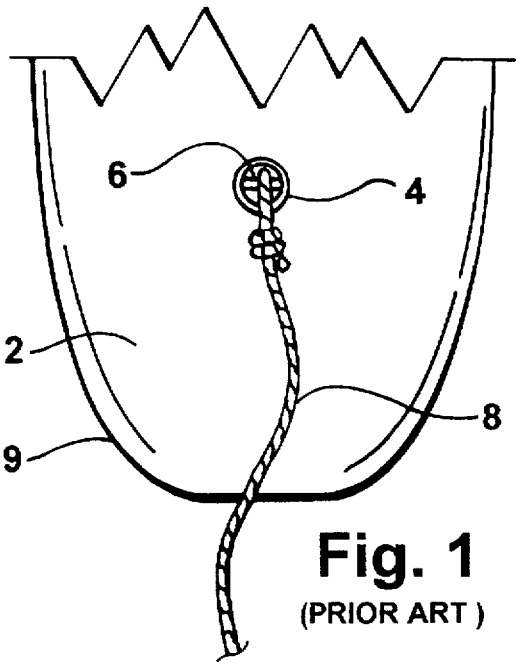
Fig. 1 (PRIOR ART)
FIG. 1 is a fractional top plan view showing the attachment of a leash in the prior art.

As shown in FIG. 1, in one prior art type of attachment for a leash, a bore was made in the top surface 2 of the surfboard. Thereafter, a substantially cylindrical or thimble-shaped plug 4 was inserted into the hole and secured there by an adhesive. The plug included a transversely-extending metal rod 6 to which the leash 8 was attached. Typically, the attachment plug was located four inches to one foot forward of the trailing edge 9 of the surfboard.

Figure 3:
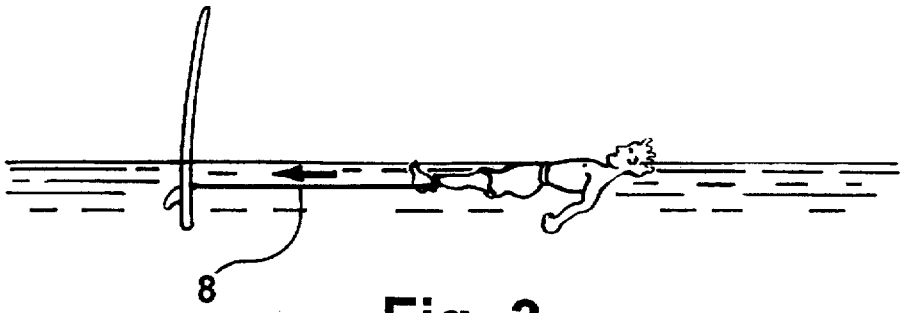
Fig. 3 (PRIOR ART)
FIG. 3 is a diagram showing a phenomenon that occurs when the leash is attached in accordance with the prior art.

One of the problems with the leash attachment method shown in FIG. 1 is illustrated in FIG. 3. Because the leash is attached some distance from the trailing edge of the surfboard, the incoming surf can catch the portion of the surfboard between the trailing edge and the point of attachment causing the surfboard to assume an attitude transverse to the direction of the incoming flow. In this position, shown in FIG. 3, the incoming flow acts against the cross sectional area of an appreciable fraction of the surfboard, resulting in a strong pull on the leash, which tends to pull the surfer toward the beach.

In addition to this problem, the attachment of FIG. 1 has a further disadvantage. Typically, the plug 4 is located in the general area of the surfboard where the surfer's rear foot is planted, and this results in discomfort and distraction for the surfer.

Figure 2:
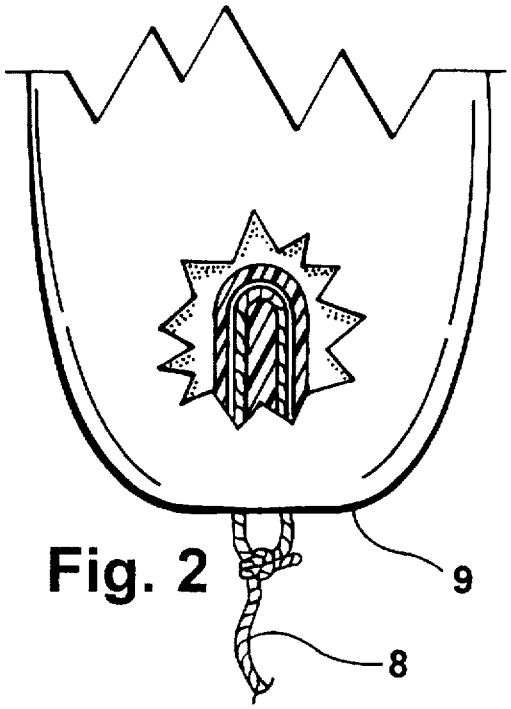
FIG. 2 is a fractional top plan view showing the attachment of a leash in accordance with the present invention.
Figure 4:
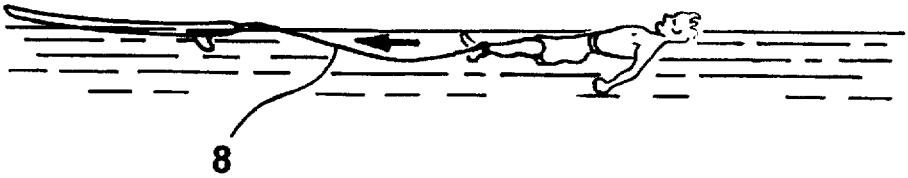
FIG. 4 is a diagram showing how the phenomenon shown in FIG. 3 is eliminated when the leash is attached in accordance with the present invention.

In contrast, as will be seen below, when the attachment of the present invention is used, the attachment point is at the trailing edge 9 of the surfboard, as shown in FIG. 2. In the event the surfer has fallen from his surfboard, the surfboard will assume the attitude shown in FIG. 4, and the force asserted by the surfboard through the leash on the ankle of the surfer is minimized because the surfboard is oriented to present a minimal cross-sectional area to the incoming flow.

Thus, in its most general expression, the present invention consists of an article for use in attaching the leash 8 to the trailing edge 9 of the surfboard. A preferred embodiment of such an attachment is described below by way of example, in connection with FIGS. 5–7 and 10. It should be understood that the preferred embodiment shown in these figures is exemplary only, and that variations on the article can be made without departing from the spirit and scope of the present invention.

In addition to the fact that it is mounted at the trailing edge of the surfboard, the success of the attachment of the present invention is a result of its ability to distribute the forces asserted by the leash over a relatively large area so that an excessive force is not concentrated at any part of the surfboard. As is generally known, modern surfboards include a core of foamed plastic that is covered with an outer skin of fiberglass resin. Because of its softness, the foam plastic core is poorly suited to withstand concentrated loads. The attachment of the present invention solves this problem by providing a plug of a very strong and rigid material, such as polycarbonate, having a surface area of several square inches over which the forces applied by the leash are dispersed into the surfboard.

Figure 5:
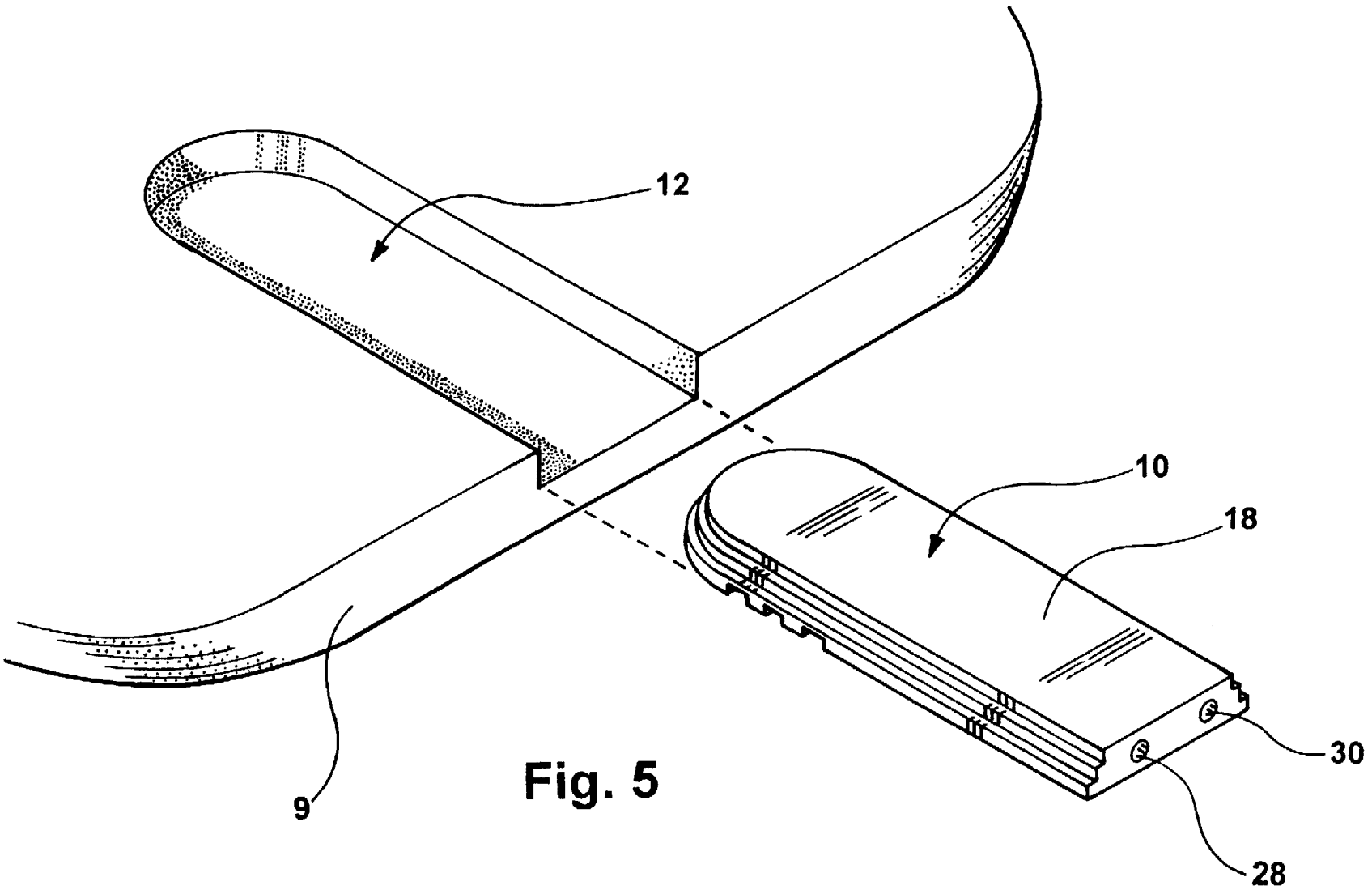
FIG. 5 is a top left rear perspective view showing how the plug is inserted into the trailing edge of a surfboard in a preferred embodiment of the present invention.

As best seen in FIG. 5, the attachment of the preferred embodiment of the present invention is a plug 10 that is inserted into a rearwardly opening cavity 12 in the trailing edge 9 of the surfboard.

Figure 6:
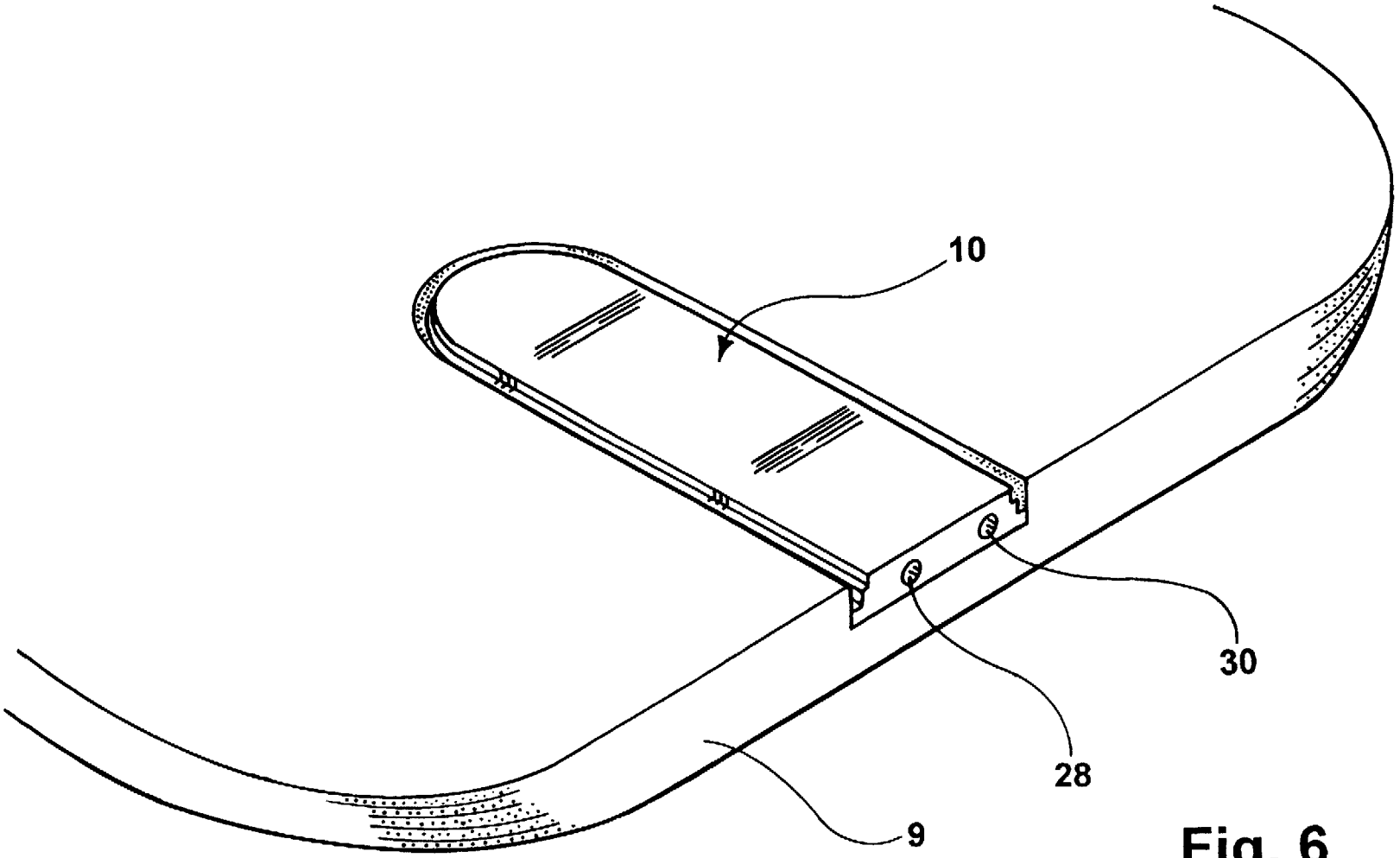
FIG. 6 is a top left rear perspective view showing the plug inserted into the trailing edge of a surfboard in a preferred embodiment of the present invention.
Figure 7:
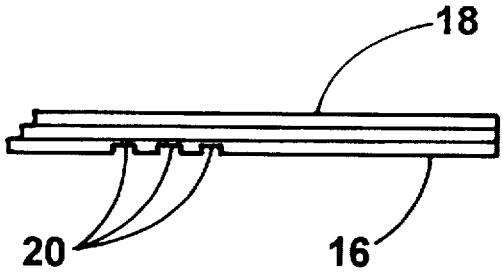
FIG. 7 is a left side elevational view of the plug in a preferred embodiment.

Externally the plug 10 includes a lower surface 16 that is wider than its exposed upper surface 18. This affords a larger area on the lower surface for bonding to the foam plastic of the interior of the surfboard. FIG. 6 shows the plug 10 reposing in the cavity 12 before the intervening space is filled with epoxy which is shaped to the contour of the surfboard.

The plug also includes transverse grooves 20 in its lower surface 16. These lateral grooves are filled with the bonding agent that is used for securing the plug to the surfboard, and when the bonding agent has cured, the portion of it in the lateral grooves 20 strongly resists any forces that would pull the plug rearwardly from the cavity.

Figure 8:
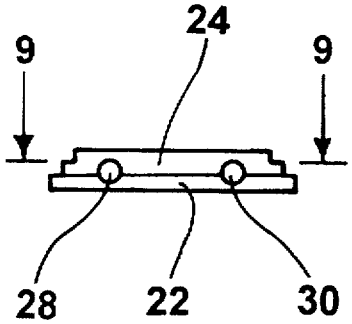
FIG. 8 is a rear elevational view of the plug in an alternative embodiment.
Figure 9:
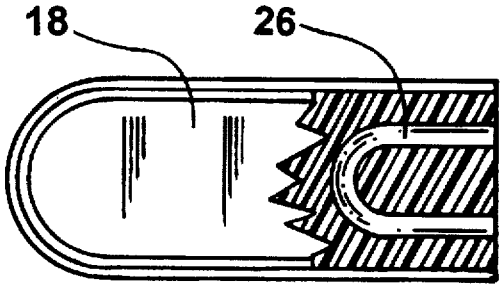
FIG. 9 is a top plan view partly cut away to show an internal passage in the alternative embodiment of FIG. 8; and, FIG. 10 is a bottom plan view of the plug of FIG. 7.
Figure 10:
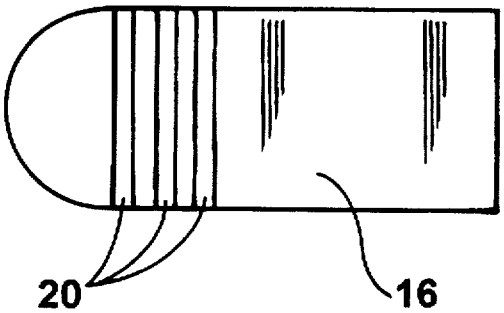

In the preferred embodiment, shown in FIGS. 5, 6, 7 and 10, the plug 10 is formed as a unitary article by injection molding. In an alternative embodiment, shown in FIGS. 8 and 9, the plug is formed by bonding together a lower piece 22 and an upper piece 24 as shown in FIG. 8.

In use, one end of a rope is threaded through the internal passage 26 and then the free ends are knotted together to form a loop, as shown in FIG. 2. A leash is then attached to the loop.

Thus, there has been described an attachment that is especially well adapted for securing a leash to the trailing edge of a surfboard. The attachment is designed for great strength, and its shape, when installed, conforms substantially to the shape of the surfboard.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. An article attachable to a surfboard having an upper surface and a trailing edge, said article serving as an attachment for securing a leash to the surfboard and comprising:

a plug received within a rearwardly-opening cavity in the trailing edge of the surfboard, said plug including an internal passage extending from a first rearwardly-opening hole to a second rearwardly-opening hole, whereby a leash may be threaded through the internal passage and thereby secured to the surfboard.

2. The article of claim 1 wherein said article comprises an upper piece and a lower piece bonded in juxtaposition.

3. The article of claim 1 wherein said article comprises a unitary article.

4. An article attachable to a surfboard having an upper surface and a trailing edge, said article serving as an attachment for securing a leash to the surfboard and comprising:

a plug received within a rearwardly-opening cavity in the trailing edge of the surfboard, shaped so that after the plug has been inserted into the rearwardly-opening cavity, the exposed surface of the plug conforms substantially to the upper surface and the trailing edge of the surfboard, said plug including an internal passage extending from a first rearwardly-opening hole to a second rearwardly-opening hole, whereby a leash may be threaded through said internal passage and thereby secured to the surfboard.

* * * * *